US010526732B2

(12) United States Patent
Rapp et al.

(10) Patent No.: US 10,526,732 B2
(45) Date of Patent: Jan. 7, 2020

(54) BRAIDING MACHINE

(71) Applicant: Bayerische Motoren Werke Aktiengesellschaft, Munich (DE)

(72) Inventors: Florian Rapp, Munich (DE); Fabian Rittershofer, Erdmannhausen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 233 days.

(21) Appl. No.: 15/724,622

(22) Filed: Oct. 4, 2017

(65) Prior Publication Data

US 2018/0023229 A1 Jan. 25, 2018

Related U.S. Application Data

(63) Continuation of application No. PCT/EP2016/057563, filed on Apr. 7, 2016.

(30) Foreign Application Priority Data

Jun. 10, 2015 (DE) ..... 10 2015 210 578

(51) Int. Cl.
*D04C 3/40* (2006.01)
*D04C 3/48* (2006.01)

(52) U.S. Cl.
CPC *D04C 3/40* (2013.01); *D04C 3/48* (2013.01)

(58) Field of Classification Search
CPC ..... D04C 3/48; D04C 3/40
USPC ..... 87/35
See application file for complete search history.

(56) References Cited

U.S. PATENT DOCUMENTS 1,830,196 A * 11/1931 Faure-Roux ..... D04C 3/40 87/29
4,976,812 A * 12/1990 McConnell ..... B29C 53/68 156/148
5,146,835 A * 9/1992 McConnell ..... B29C 53/68 87/1
5,203,249 A * 4/1993 Adams ..... D04C 3/48 87/34

(Continued)

FOREIGN PATENT DOCUMENTS

CN 101555649 A 10/2009
DE 101 15 953 A1 10/2002

(Continued)

OTHER PUBLICATIONS

International Search Report (PCT/ISA/210) issued in PCT Application No. PCT/EP2016/057563 dated Jun. 22, 2016 with English translation (five pages).

(Continued)

*Primary Examiner* — Shaun R Hurley
(74) *Attorney, Agent, or Firm* — Crowell & Moring LLP

(57) ABSTRACT

To ensure during the braiding of braiding cores, which have a complex braiding core geometry or vastly different side lengths, that the braiding threads are always correctly following the braiding core contour in terms of storage, at least two braiding rings are provided, which have a constant opening cross-section and are arranged in series directly adjacent to one another. The opening cross-sections delimited by the braiding rings overlap at least partially. The braiding rings are adjustable independently of one another.

13 Claims, 7 Drawing Sheets

(56) References Cited

U.S. PATENT DOCUMENTS

| | | | | |
|---|---|---|---|---|
| 5,320,696 | A * | 6/1994 | McConnell | B29C 53/68 156/148 |
| 5,361,674 | A | 11/1994 | Akiyama et al. | |
| 6,679,152 | B1 | 1/2004 | Head et al. | |
| 8,006,601 | B2 * | 8/2011 | Inazawa | B29C 53/588 87/1 |
| 8,671,817 | B1 * | 3/2014 | Bogusky | D04C 3/48 87/35 |
| 2009/0249836 | A1 | 10/2009 | Stingel | |
| 2016/0355956 | A1 * | 12/2016 | Baumgart | D04C 3/12 |
| 2018/0016718 | A1 * | 1/2018 | Rapp | D04C 3/48 |

FOREIGN PATENT DOCUMENTS

| | | | |
|---|---|---|---|
| DE | 10 2008 052 668 | A1 | 5/2010 |
| DE | 10 2010 021 371 | A1 | 12/2011 |
| DE | 10 2010 047 193 | A1 | 4/2012 |
| JP | 4-108147 | A | 4/1992 |
| JP | 5-117951 | A | 5/1993 |
| JP | 2013-216982 | A | 10/2013 |

OTHER PUBLICATIONS

German-language Written Opinion (PCT/ISA/237) issued in PCT Application No. PCT/EP2016/057563 dated Jun. 22, 2016 (six pages).

German Search Report issued in counterpart German Application No. 10 2015 210 578.4 dated Mar. 17, 2016 with partial English translation (12 pages).

English Translation of Chinese-language Office Action issued in counterpart Chinese Application No. 201680013833.9 dated Oct. 29, 2018 (six (6) pages).

Japanese-language Office Action issued in counterpart Japanese Application No. 2017-554008 dated Oct. 24, 2018 with partial English translation (eight (8) pages).

* cited by examiner

BRAIDING MACHINE

CROSS REFERENCE TO RELATED APPLICATIONS

This application is a continuation of PCT International Application No. PCT/EP2016/057563, filed Apr. 7, 2016, which claims priority under 35 U.S.C. § 119 from German Patent Application No. 10 2015 210 578.4, filed Jun. 10, 2015, the entire disclosures of which are herein expressly incorporated by reference.

BACKGROUND AND SUMMARY OF THE INVENTION

The invention relates to a braiding machine, in particular a circular braiding machine, for braiding a braiding core that is fed in a permanently continuous or pendulous manner, having at least two braiding thread spools and having a braiding ring that is disposed between the braiding thread spools and the run-on point of the braiding threads onto the braiding core. The braiding threads are guided over the internal surface of the braiding ring.

In braiding machines, in particular in circular braiding machines, braiding cores which have a cross section that is consistent or changes substantially in the longitudinal direction of the braiding core are often fed in order for the component to be produced to be imparted the later shape thereof.

The braiding cores herein can remain in the later component or be released therefrom as a lost core.

Individual threads or else braiding fibers, for example rovings from carbon or glass fibers, can be used as braiding threads.

So-called preforms which serve for the downstream production of diverse components from fiber-reinforced plastics can be made from these braiding threads or braiding fibers by braiding the latter about a braiding core. It is mandatory herein, with a view to high quality of the later components, that the braiding threads or braiding fibers are deposited onto the braiding core as precisely as possible.

In the case of the conventional braiding procedure, the braiding thread spools are received by bobbins which are moved relative to one another on guide tracks such that a braided product is created. The bobbins herein have dissimilar directions of revolving about the braiding core.

In the case of circular braiding machines, the guide tracks are two concentric circular paths that move in opposite directions, the braiding core to be braided moving in the center of said paths so as to be axially offset. It is thus achieved that the braiding threads or braiding fibers of the bobbins in the positive direction of rotation continuously cross those of the negative direction of rotation such that a circular braided product is formed as a braided core is braided.

If braided cores having a complex core geometry are used in the braiding machines, a uniform meshwork structure cannot be achieved by way of the usually round braiding rings with a constant opening cross section.

Differences, which in some instances are significant in terms of the local braiding angle, the layer thickness, and the thread concentration on the individual sides of the braiding core, are created when rigid braiding rings having a round opening cross section are used, even in the case of braiding core cross sections having very dissimilar lateral lengths.

In the case of curved braiding cores, dissimilar braided structures are also created on the internal and the external radius of the curvature when the known rigid braiding rings having a round opening cross section are used.

In order to redress this, DE 10 2010 047 193 A1 describes a circular braiding machine which has a braiding ring made from four angled segments which can all be simultaneously displaced radially toward the braiding core or away from the latter by the same displacement path. The individual segments mutually overlap on the free ends thereof. The adjustment installations engage in the angled region thereof.

This arrangement has the disadvantage that the individual segments of the braiding ring can follow changes in the cross section of the braiding core only when said changes run symmetrically to the longitudinal axis of the braiding ring. Local convexities or concavities, respectively, of the braiding core cannot be followed, such that the quality of the braided product is compromised. Likewise, braiding cores having very dissimilar lateral lengths cannot be braided with adequate quality.

Another solution is known from U.S. Pat. No. 6,679,152 B1. Here, at least one adjustable braiding ring in the manner of an iris aperture is provided in the case of a circular braiding machine. Here too, all segments can only be adjusted simultaneously by the same angular increment. Therefore, it is also not possible for a unilaterally changing cross-sectional shape of the braiding core to be followed with this braiding ring.

It is an object of the present invention to provide a braiding machine using a rigid braiding ring such that the braiding ring opening cross section, both in terms of the circumference as well as of the geometric shape, can be adapted to the respective braiding core cross section.

This object is achieved according to the invention by a braiding machine, in particular a circular braiding machine, for braiding a braiding core that is fed in a permanently continuous manner, having at least two braiding thread spools and having a braiding ring that is disposed between the braiding thread spools and the run-on point of the braiding threads onto the braiding core. The braiding threads are guided over the internal surface of the braiding ring. At least two braiding rings having a constant opening cross section are disposed in series so as to be mutually adjacent in such a manner that the opening cross sections that are delimited by the braiding rings form an overlap opening which corresponds geometrically to the momentary braiding core cross section. The two braiding rings are disposed so as to be individually adjustable.

The invention is based on the concept that the cross section of a braiding core can be represented by at least two rigid braiding rings even when these two braiding rings are positioned such that the opening cross sections thereof are at least partially superimposed such that the overlap opening thus created in terms of geometry approximates most closely the braiding core cross section that is momentarily to be braided. The meshwork structure can thus be kept substantially more consistent, or be influenced in a localized targeted manner, respectively. The overlap opening of the at least two braiding rings can thus be adapted to almost all cross-sectional changes in the braiding core in an optimal manner, and thus guide the braiding threads or braiding fibers, respectively, in an optimal manner. On account thereof, it is possible for the positionally correct run-on point of the braiding threads onto the respective braiding core area to always be guaranteed. Above all, however, the clear spacing between the internal surface of the cross section by overlap and the run-on point can also be minimized at all times. The adaptation of the overlap opening of the braiding rings herein is performed during the braiding procedure.

In particular embodiments, the braiding rings each have an annular opening cross section, an ellipsoidal opening cross section or an ovoid opening cross section. By way of these particularly suitable opening cross sections for the individual braiding rings, the braiding core cross sections that are currently in use today can almost all be fully represented.

In the case of two or more braiding rings being used, the latter can also be disposed so as to nest in one another.

Depending on the braiding core cross section, it is expedient for three braiding rings to be used that, in terms of the opening cross section, are geometrically identical. Each braiding ring herein is separately adjustable such that the opening cross section that is set conjointly by all three braiding rings can be adapted to almost any arbitrary cross section of the braiding core.

In a further aspect of the invention, each braiding ring in the braiding ring plane is disposed so as to be adjustable in a by-axial translatory manner. Still further, each braiding ring may be adjustable by way of a linear guide. A spindle drive that is capable of separate actuation may be provided for adjusting each one of the braiding rings. These aspects of the invention describe an advantageous potential pertaining to how the adjustment of the individual braiding rings can be carried out in a favorable device-related manner. Timing belts can also be used instead of the spindle drive. The individual braiding rings can be actuated in a simple manner by way of the timing belts. This construction is also very rugged.

Apart from a horizontal and vertical adjustability of the braiding rings (x-axis and y-axis), it can moreover be expedient in the case of specific braiding ring geometries for a rotation about the z-axis to be provided when the braiding rings have an opening cross section that deviates from that of an annulus.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
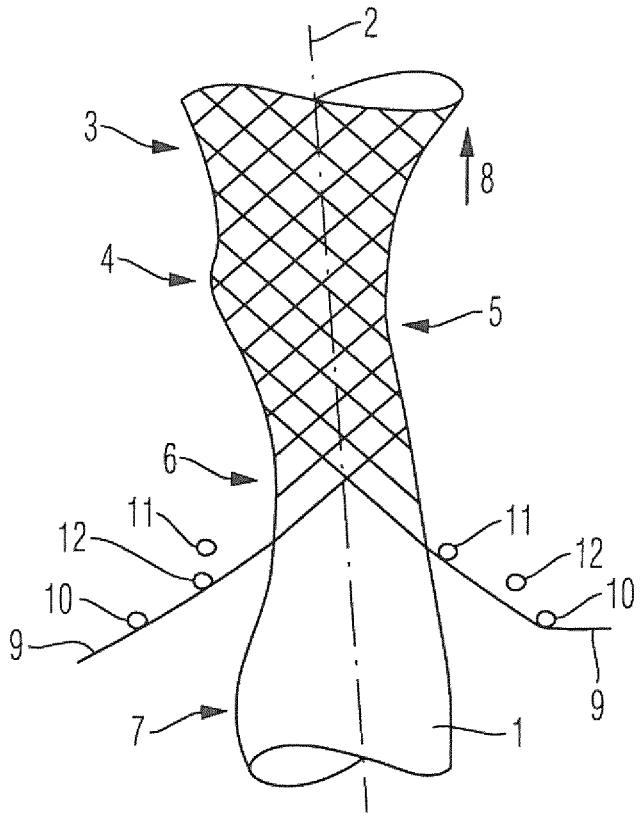
FIG. 1 is a side view of a braiding core having braiding threads running onto said braiding core.

A side view of a part of a braiding core 1 is illustrated in FIG. 1.

The braiding core 1 has a longitudinal axis 2 and changing cross-section faces which are not always disposed symmetrically to the longitudinal axis 2 of the braiding core 1. The braiding core 1 in the circumferential region 3 thus has a symmetric encircling cross-sectional enlargement, while the braiding core 1 in the circumferential region 4 has a unilateral convexity and in the circumferential region 5 has a unilateral depression. This, in the circumferential region 6, is adjoined by a symmetric constriction which then is again symmetrically enlarged toward the circumferential region 7.

The transitions between the individual regions in the example illustrated are continuous but can also be abrupt or stepped.

The transportation direction of the braiding core is identified by 8.

Typically, a multiplicity of braiding threads or braiding fibers 9, and possibly also additional filler threads or 0° threads (not shown) run onto the braiding core 1. For the purpose of visualization, only two braiding threads or braiding fibers 9 are illustrated in this example. The braiding threads or braiding fibers 9 are drawn from braiding thread spools (not illustrated in more detail). The braiding threads or braiding fibers 9 in this example are deflected by the internal circumference of a first rigid braiding ring 10. This braiding ring 10 has a constant invariable diameter which is larger than the largest diameter of the braiding core 1 to be braided.

This first braiding ring 10 can also be dispensed with, depending on the arrangement of the braiding thread spools.

Two braiding rings 11 and 12, the arrangement of which and the adjustment possibilities of which will be described further below, are disposed close to the run-on point of the braiding threads 9 on the circumference of the braiding core 1 in FIG. 1. Depending on the braiding core contour that is present at the run-on point of the braiding threads 9, the two braiding rings 11, 12 are adjusted in relation to one another and in relation to the braiding core contour such that at least part of the internal circumferential face of the braiding rings 11, 12 is located very close to the momentarily wound surface contour of the braiding core 1, and that the braiding threads 9 are deflected in an almost parallel manner and at a minor spacing from the surface of the braiding core 1.

Figure 2:
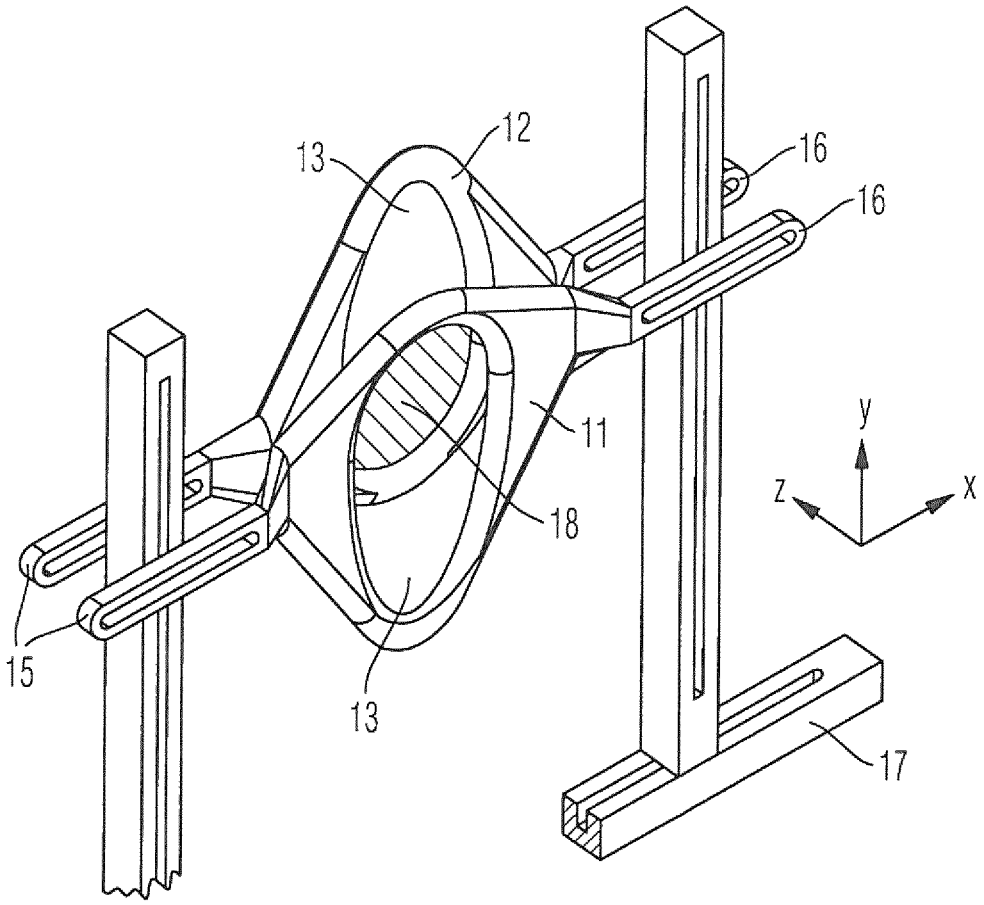
FIG. 2 is a first embodiment of the invention, having two braiding rings.

FIG. 2 shows a first design embodiment of the invention, in a perspective in-principle illustration. The two braiding rings 11, 12 each have an ovoid opening cross section 13. The two braiding rings 11, 12 are held by two lugs 15, 16 that are disposed laterally and by way of which the two braiding rings 11, 12 are disposed on a frame 17, on the front and the rear side of the latter. Drive installations (not illustrated) are provided in or on the frame 17, wherein each braiding ring 11 and 12 has a dedicated drive installation that is actuatable independently of the other braiding ring. Each drive installation permits the assigned braiding ring 11 or 12 a horizontal (displacement by the x-axis) and a vertical (displacement by the y-axis) adjustment. On account thereof, the overlap opening 18 that is superimposed conjointly by both braiding rings 11, 12 is varied. This overlap opening 18 geometrically as far as possible corresponds to the momentary braiding core cross section such that the braiding threads run onto the circumference of the braiding core in a correctly deposited manner.

Linear slides having spindle or timing belt drives are preferred as a drive installation. In the case of these braiding rings 11, 12 having a non-circular opening cross section, it can also be expedient for the braiding rings 11, 12 to even be additionally rotated (adjustment about the z-axis).

If the lugs 15, 16 are additionally cranked or angled, the two braiding rings 11, 12 can be disposed very close to one another, as is visualized in FIG. 2.

The adjustment of the braiding rings 11, 12 is performed during the braiding procedure such that it is guaranteed at all times that the run-on point of the braiding threads 9 lies close to the momentary circumference of the braiding core 1, even if the cross section of the latter changes.

Figure 3:
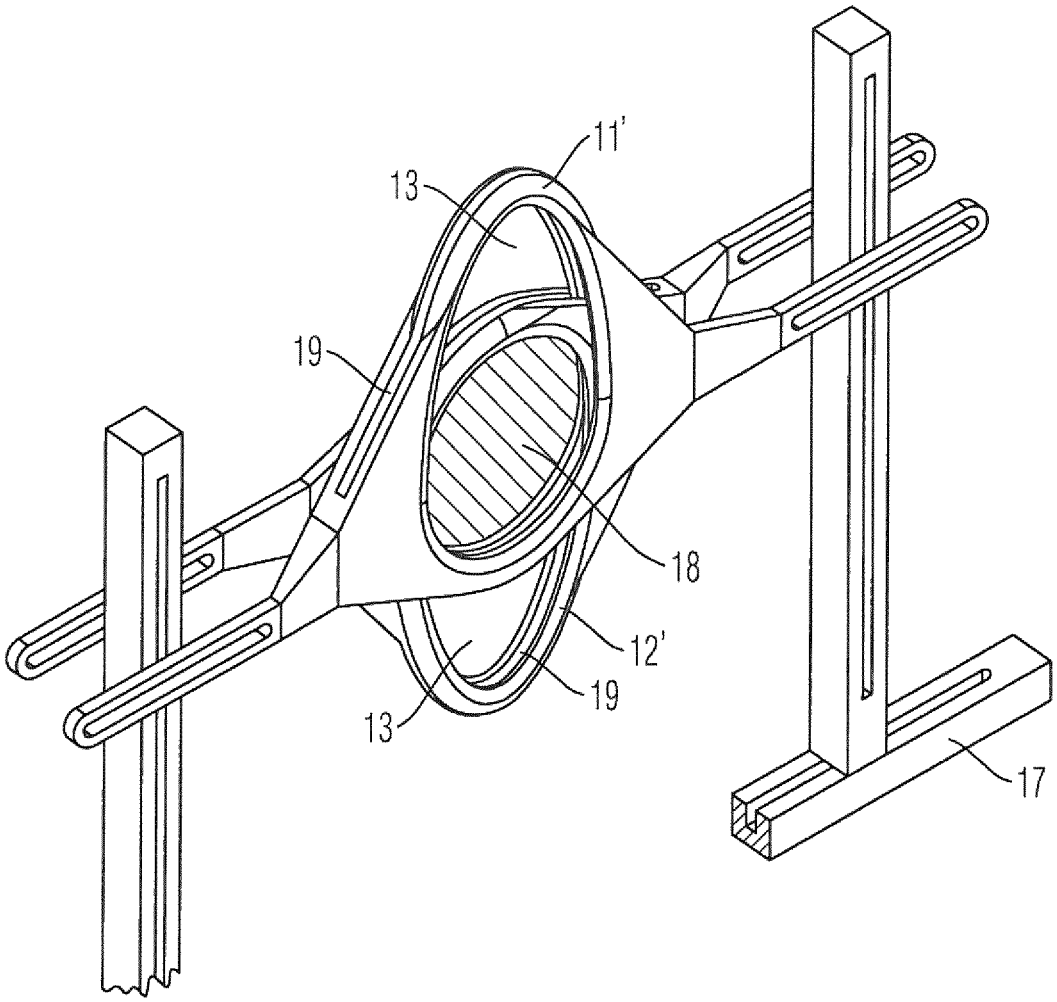
FIG. 3 is a second embodiment of the invention, having two braiding rings nested in one another.
Figure 4A:
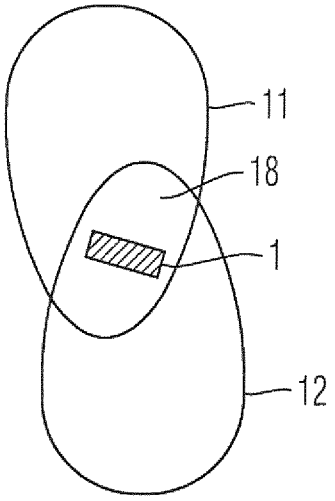
FIGS. 4A to 4D show a combination of two ovoid braiding rings.
Figure 4B:
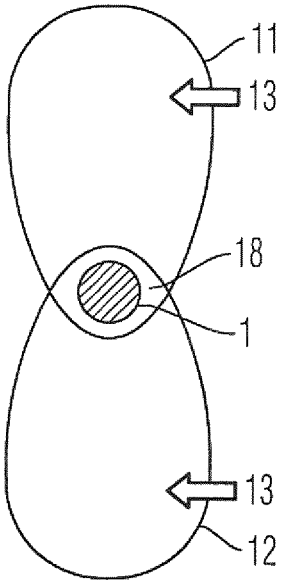
Figure 4C:
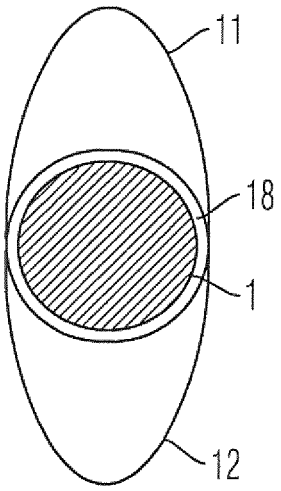
Figure 4D:
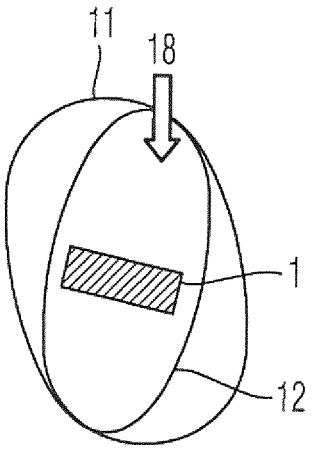

The solution as per FIG. 3 differs from the arrangement as per FIG. 2 in that the braiding rings 11', 12' on the circumference thereof each have one slot 19 such that the braiding rings 11', 12' can be placed into one another, or are able to be nested in one another, so to speak. The two braiding rings 11', 12' thus act practically as one single guide for the braiding threads. The explanations made with reference to the description of FIG. 2 otherwise also apply here.

Various combinations of, in each case, two braiding rings 11, 12, or 11', 12', respectively, having an ovoid opening cross section 13 are illustrated in front views in FIGS. 4A to 4D. Various cross-sectional shapes of braiding cores 1 are plotted in the respective overlap opening 18. As can be readily seen, both small and large round cross sections of braiding cores (FIGS. 4B, 4C) as well as small and comparatively large rectangular braiding core cross sections (FIGS. 4A, 4D) can be processed using suitable combinations of ovoid braiding rings. Aspect ratios (W/H) of up to 3:1 can be processed herein.

Figure 5A:
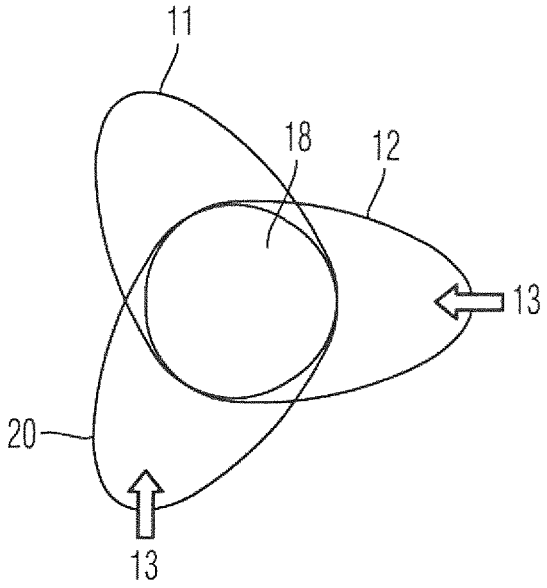
FIGS. 5A to 5D show a combination of three ovoid braiding rings.
Figure 5B:
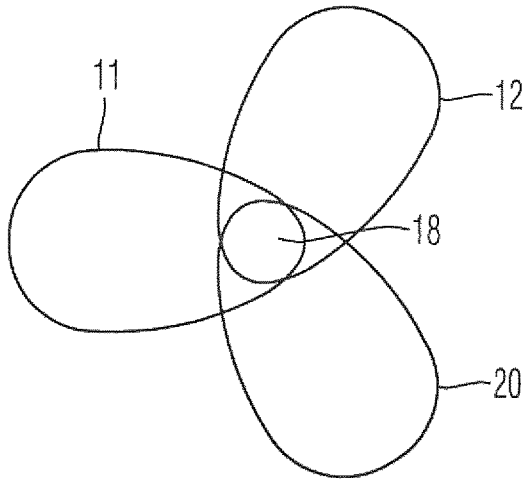
Figure 5C:
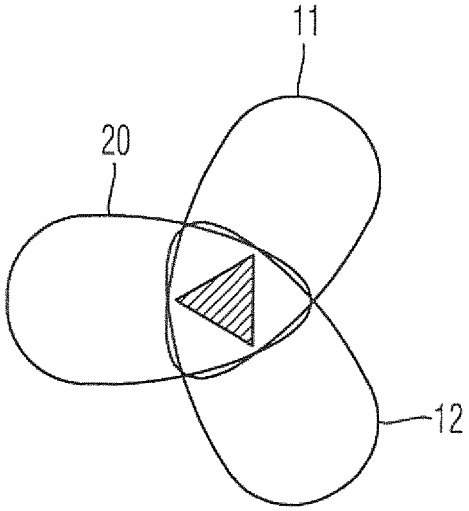
Figure 5D:
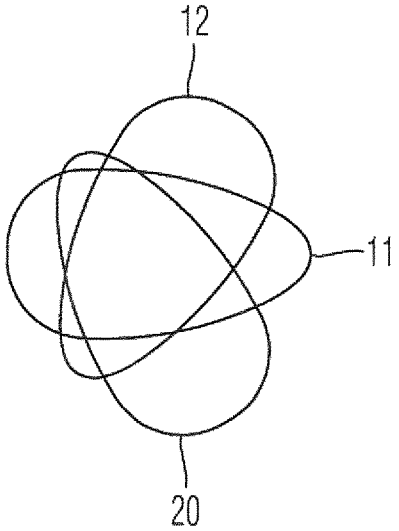
Figure 6A:
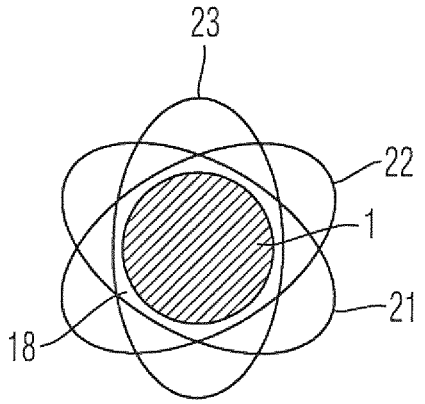
FIGS. 6A to 6D show a combination of three ellipsoidal braiding rings.
Figure 6B:
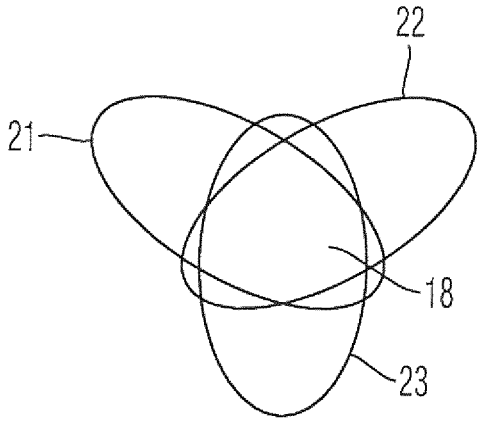
Figure 6C:
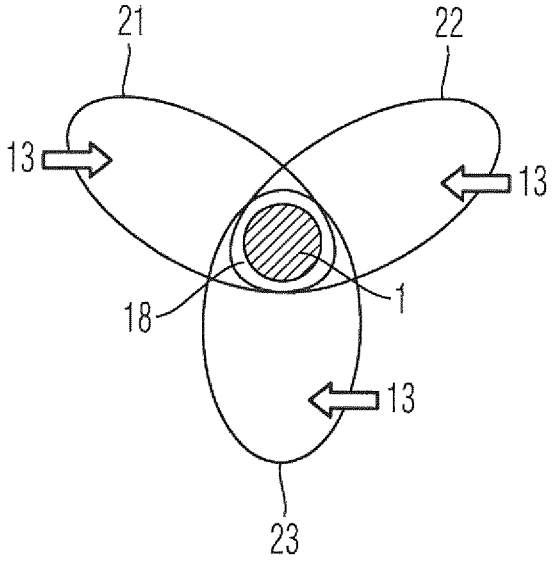
Figure 6D:
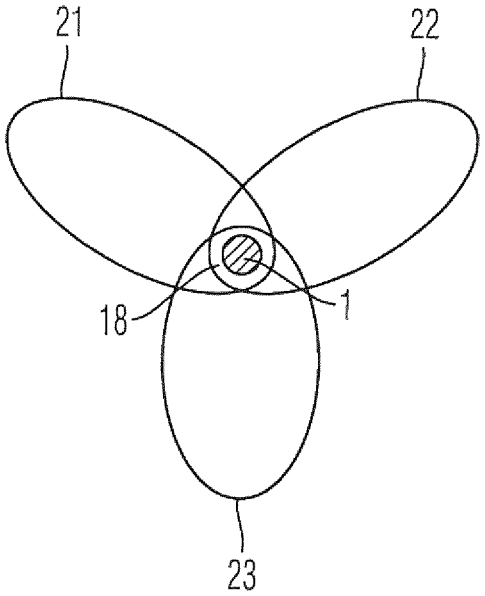
Figure 7A:
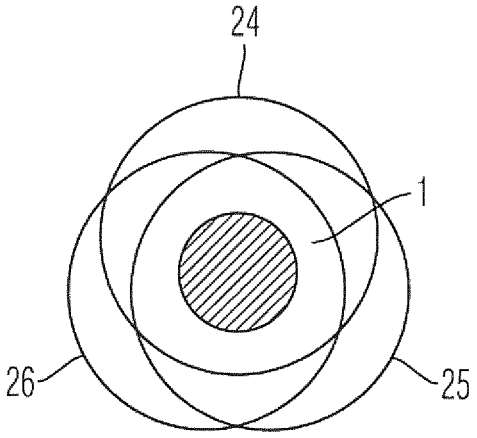
FIGS. 7A to 7D show a combination three annular braiding rings.
Figure 7B:
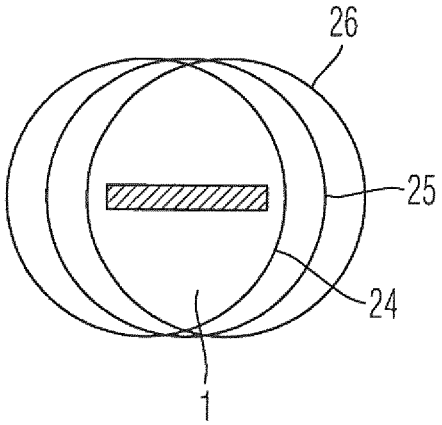
Figure 7C:
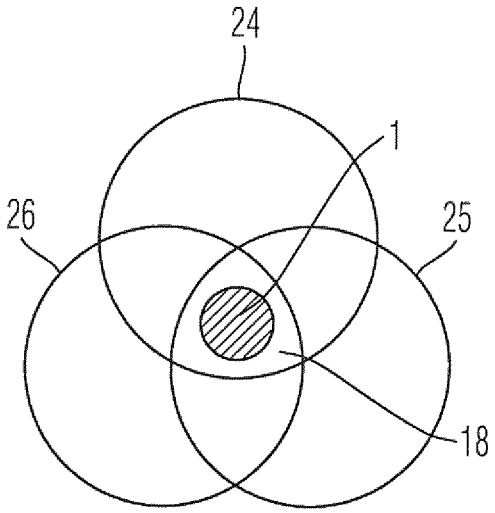
Figure 7D:
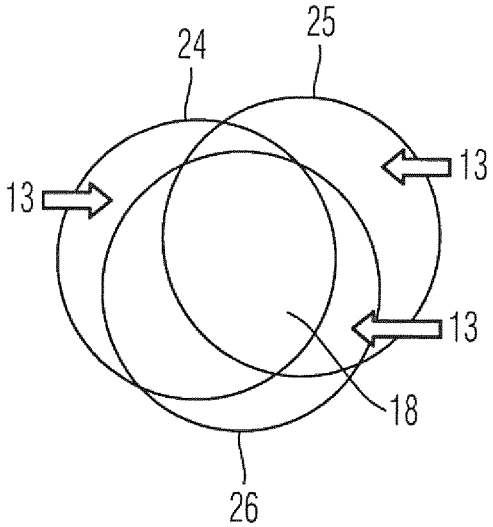

Various combinations of three braiding rings 11, 12, 20, having in each case an ovoid opening cross section, are illustrated in a front view in FIGS. 5A to 5D. The braiding rings can be fastened and drivable in a manner analogous to that of FIG. 2. It can also be readily seen here that an overlap opening 18 having very dissimilar opening cross section can likewise be adjusted for the most varied braiding core contours by way of the three braiding rings. As is shown in FIG. 5C, triangular braiding core cross sections can thus also be braided with high quality.

As is illustrated in the front views in FIGS. 6A to 6D, combinations of braiding rings 21, 22, 23 having an ellipsoidal opening cross section can also be used instead of braiding rings with an ovoid opening cross section. Very dissimilar overlap openings 18 can also be implemented here by way of the most varied mutual adjustments of the three braiding rings 21, 22, 23.

Combinations of in each case three braiding rings 24, 25, 26 having circular opening cross sections 13 are shown in a front view in each of FIGS. 7A to 7D. Very dissimilar overlap openings 18 can likewise be produced on account thereof, such that this braiding ring arrangement can also be adapted to different braiding core cross sections so as to provide a high deposition quality.

LIST OF REFERENCE SIGNS

1 Braiding core
2 Longitudinal axis of 1
3 to 7 Circumferential regions of 1
8 Transportation direction of 1
9 Braiding thread
10 Rigid braiding ring
11 First adjustable braiding ring
12 Second adjustable braiding ring
11', 12' Nested braiding rings
13 Ovoid opening cross section of 11
14 Ovoid opening cross section of 12
15 Lug
16 Lug
17 Frame
18 Overlap opening
19 Slot of 11, 12
20 Third adjustable braiding ring
21, 22, 23 Adjustable braiding rings having an ellipsoidal opening cross section
24, 25, 26 Adjustable braiding rings having a circular opening cross section The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A braiding machine for braiding a braiding core that is fed in a continuous manner, the braiding machine comprising:

at least two braiding thread spools;

at least two braiding rings having a constant opening cross section disposed in series so as to be mutually adjacent such that the constant opening cross sections delimited by the at least two braiding rings form an overlap opening that corresponds geometrically to a momentary braiding core cross section, wherein the at least two braiding rings are disposed between the braiding thread spools and a run-on point of braiding threads onto the braiding core, and the at least two braiding rings are disposed so as to be individually adjustable laterally relative to an axis passing through the constant opening cross sections of the at least two braiding rings.

2. The braiding machine according to claim 1, wherein the braiding machine is a circular braiding machine.

3. The braiding machine according to claim 1, wherein the at least two braiding rings each have an annular opening cross section.

4. The braiding machine according to claim 1, wherein the at least two braiding rings each have an ellipsoidal opening cross section.

5. The braiding machine according to claim 1, wherein the at least two braiding rings have an ovoid opening cross section.

6. The braiding machine according to claim 1, wherein the at least two braiding rings are disposed in a mutually engaging manner.

7. The braiding machine according to claim 1, wherein the at least two braiding rings include three braiding rings of identical type are provided so as to be directly adjacent.

8. The braiding machine according to claim 1, wherein each braiding ring of the at least two branding rings in a braiding ring plane is disposed so as to be adjustable in a bi-axial translatory manner.

9. The braiding machine according to claim 8, wherein each braiding ring of the at least two branding rings is adjustable by way of a linear guide.

10. The braiding machine according to claim 1, wherein each braiding ring of the at least two branding rings is adjustable by way of a linear guide.

11. The braiding machine according to claim 1, wherein a spindle drive that is capable of separate actuation is provided for adjusting each one of the at least two braiding rings.

12. The braiding machine according to claim 6, wherein a spindle drive that is capable of separate actuation is provided for adjusting each one of the at least two braiding rings.

13. The braiding machine according to claim 7, wherein a spindle drive that is capable of separate actuation is provided for adjusting each one of the at least two braiding rings.

* * * * *